US007144361B2

(12) United States Patent
Aizawa et al.

(10) Patent No.: US 7,144,361 B2
(45) Date of Patent: Dec. 5, 2006

(54) CONTINUOUS FLOW TYPE CENTRIFUGE HAVING ROTOR BODY AND CORE BODY DISPOSED THEREIN

(75) Inventors: Masaharu Aizawa, Hitachinaka (JP); Yoshinori Tobita, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 124 days.

(21) Appl. No.: 10/833,161

(22) Filed: Apr. 28, 2004

(65) Prior Publication Data

US 2004/0214711 A1 Oct. 28, 2004

(30) Foreign Application Priority Data

Apr. 28, 2003 (JP) ..... 2003-124431

(51) Int. Cl.
*B04B 1/04* (2006.01)
*B04B 7/08* (2006.01)

(52) U.S. Cl. ..... 494/38; 494/79; 494/81

(58) Field of Classification Search ..... 494/38, 494/43, 46, 60, 62, 64, 67, 74, 79, 81; 210/380.1
See application file for complete search history.

(56) References Cited

U.S. PATENT DOCUMENTS

| | | | | |
|---|---|---|---|---|
| 1,644,615 | A * | 10/1927 | Sharples | 494/12 |
| 2,563,550 | A * | 8/1951 | Quist | 494/65 |
| 2,819,014 | A * | 1/1958 | Zabriskie, Jr. | 494/22 |
| 3,288,360 | A * | 11/1966 | Babelay et al. | 494/67 |
| 3,430,849 | A * | 3/1969 | Nunley et al. | 494/12 |
| 3,536,253 | A * | 10/1970 | Anderson et al. | 494/27 |
| 3,730,422 | A * | 5/1973 | Cho | 494/74 |
| 4,790,808 | A * | 12/1988 | Piramoon | 494/81 |
| 5,123,897 | A * | 6/1992 | Hackenberg et al. | 494/82 |
| 5,484,383 | A * | 1/1996 | Fitch, Jr. et al. | 494/48 |
| 6,363,611 | B1 * | 4/2002 | Sheldon et al. | 29/889 |
| 6,939,286 | B1 * | 9/2005 | Hurdlow | 494/56 |
| 2003/0114289 | A1 * | 6/2003 | Merino et al. | 494/37 |
| 2004/0214711 | A1 * | 10/2004 | Aizawa et al. | 494/79 |

FOREIGN PATENT DOCUMENTS

| | | | |
|---|---|---|---|
| GB | 2143752 | * | 2/1985 |
| JP | 48-28863 | | 9/1973 |
| JP | 7-106328 | | 11/1995 |
| JP | 2000-140707 | * | 5/2000 |
| JP | 2005-118689 | * | 5/2000 |

* cited by examiner

*Primary Examiner*—Charles E. Cooley
(74) *Attorney, Agent, or Firm*—Antonelli, Terry, Stout and Kraus, LLP.

(57) ABSTRACT

A continuous flow type centrifuge to which a liquid sample is continuous supplied. The centrifuge includes a rotor rotatably supported by a main housing and drivingly rotated by a motor. The rotor includes a cylindrical rotor body, a hollow cylindrical core body, and end plates. The hollow cylindrical core body is disposed in the rotor body providing a space therebetween. The core body has an upper open end, a lower open end and an outer peripheral surface provided with a plurality of partitioning walls positioned at an equal interval in a circumferential direction of the core body for providing a plurality of cavities each defined by the core body, the rotor body and neighboring partitioning walls. The end plates include an upper end plate disposed to cover the upper open end, and a lower end plate disposed to cover the lower open end. An upper welding part is disposed at a boundary between the upper end plate and the upper open end, and a lower welding part is disposed at a boundary between the lower plate and the lower open end. The components of the rotor are made from heat resistant and corrosion resistant material, typically titanium or titanium alloy.

7 Claims, 5 Drawing Sheets

CONTINUOUS FLOW TYPE CENTRIFUGE HAVING ROTOR BODY AND CORE BODY DISPOSED THEREIN

BACKGROUND OF THE INVENTION

The present invention relates to a continuous flow type centrifuge adapted to centrifugally separate micro-particles contained in a liquid sample from the liquid by continuously feeding the liquid sample into a rotor.

A conventional centrifuge provided with a cylindrical rotor is described in Japanese Utility Model Publication No.48-28863 which concerns separation of viruses in a liquid medium. The disclosed centrifuge includes a rotor body made of an aluminum alloy and a hollow core made from a high tenacity aluminum alloy and disposed in the rotor body. Axial open ends of the hollow core are closed by respective threaded caps. Rubber-made O-rings are interposed between each cap and the open end portion of the hollow core for maintaining a sealed and airtight condition.

Japanese Patent Publication No. 7-106328 also describes a continuous flow type centrifuge. These conventional centrifuges are operated while the specimen to be centrifuged is isolated from the atmosphere. Flow passage is made from a material that can withstand a high temperature of 130° C.

FIG. 7 schematically illustrates an example of a conventional continuous flow type centrifuge and a cylindrical rotor provided therein. In the continuous flow type centrifuge 101, a liquid sample is fed into the cylindrical rotor 105 that is continuously rotating about its axis. The continuous centrifuge 101 is designed to separate viruses and cultured microbes on a large scale so as to refine raw materials to be used for vaccines and medicines. The vertically arranged cylindrical rotor 105 is supported to a main housing 103 by upper and lower hollow vertical rotation shafts 134, 135 that respectively axially extend from upper and lower covers 132, 133 respectively. Fluid paths are provided to allow the inside of the rotor 105 to communicate with the hollow sections of the rotation shafts 134, 135 so as to form a continuous liquid flow passage that passes through the rotation shafts 135, 134 and the rotor 105. The upper rotation shaft 134 is linked to a drive motor 109 so as to drivingly rotate the cylindrical rotor 105 about its axis.

The lower rotation shaft 135 is rotatably supported by a sliding bearing and a damper section 110 disposed along the outer periphery thereof for the purpose of centering and reduction of rotary vibrations. The upper and lower rotation shafts 134, 135 are provided at the ends thereof respectively with mechanical seals 111, 112 so that the liquid sample can flow through the rotor 105 and the rotation shafts 135, 134 while these are rotating at high speed. Connectors 115, 116 are respectively connected to the upper and lower rotation shaft 134, 135 and pipes (not shown) typically made of a plastic material are connected to respective connectors 115, 116. Therefore, the liquid sample can be fed into the rotor 105 for centrifugal operation and the liquid sample subjected to the centrifugal operation can be discharged out of the rotor 105 by a transfer unit such as a pump. Although not shown, a storage container is provided for collecting the centrifuged and discharged liquid sample.

SUMMARY OF THE INVENTION

According to a recent trend, continuous centrifuges of this type is provided with a cylindrical rotor body made from a titanium alloy whereas a core is a solid structure and is made from a plastic material having a relatively high strength as shown in FIG. 8. A hollow space is defined between an inner peripheral surface of a rotor body 230 and an outer peripheral surface of the core 221, and the hollow space is sectioned by a plurality of protrusions 222A radially outwardly protruding from the core 221 as shown in FIG. 9.

Specimens that are treated by centrifuges of this type typically include suspensions of influenza virus and those of Japanese encephalitis virus, which are to be used as raw materials for manufacturing vaccines and medicines. Therefore, it is highly desirable that centrifuges of this type are free from invasions of foreign objects and contaminations by microbes and germs that may be taken place during centrifuging operations if the apparatus is defective. It is also desirable that the components of the centrifuge that are exposed to the flowing specimen can be washed not only with ordinary detergents but also with alkaline detergents so that specific proteins and microbes contained in the specimen can suitably be washed out.

A steam sterilization process conducted normally at 121° C. for 20 minutes is effective for sterilizing the centrifuge. An aqueous solution of caustic soda containing caustic soda to a low concentration (by less than 5%) is preferably used as detergent because it can effectively decompose proteins.

According to the rotor structure shown in FIGS. 8 and 9, the solid core 221 alone made from plastic material Is available for sterilization by steam. However, the present inventors found that a steam sterilization process is not applicable when the core 221 is assembled into the rotor body 230 and the rotor body 230 is set to a housing (corresponding to the housing 103 in FIG. 7). This is due to the great difference in thermal expansion coefficient between the plastic material of which the core is made and the metal of which the rotor is made. When the plastic core 221 and the metal rotor body 230 are subjected to a steam sterilization process at 121° C. for 20 minutes in the assembled condition, the core 221 in the rotor body 230 expands remarkably to out-size the inner dimensions of the rotor body 230 and becomes deformed and damaged.

Further, regarding the sealing arrangement using the O-rings interposed between the caps and the aluminum alloy rotor body as disclosed In the Japanese Utility Model Publication No. 48-28863, minute gaps may extend from the outer surface of the rotor body to the O-ring. Therefore, microbes can presumably be entered into the minute gaps Then, the living microbes in the gap may contaminate the specimen. Additionally, from the cleaning point of view, the aluminum alloy itself (which is a material of the rotor body) may be dissolved into an alkaline detergent such as a low concentration aqueous solution of caustic soda (aqueous solution of sodium hydroxide).

Furthermore, the minute gap is not suited for cleaning. Still additionally, the highly tenacity aluminum alloy is subjected to heat treatment process that is conducted at 100 to 120° C. for the purpose of enhancing the strength. Thus, the rotor body made from aluminum alloy may be degraded when the rotor body is subjected to a steam sterilization process that is conducted at 121° C., which exceeds the heat treatment temperature.

For these reasons, a chemical solution sterilization process using ethanol or formalin is mainly employed for the continuous centrifuges of the type. However, certain chemical solutions that are used for such processes do not exhibit any sterilization effect relative to certain microbes and viruses. Finally, troublesome and time consuming labor is required for the operator if cleaning to the continuous centrifuges are performed with hot water and/or a neutral detergent.

In view of the above-identified circumstances, it is therefore an object of the present invention to provide a continuous and sealed type centrifuge to which a steam sterilization process is applicable as a common effective sterilization method in a state where a rotor is assembled to a housing of the centrifuge.

Another object of the present invention is to provide such a continuous and sealed type centrifuge capable of being cleaned with an alkaline detergent highly effective for cleaning a specimen flow passage and capable of providing a sufficient mechanical strength withstanding high centrifugal acceleration.

Theses and other objects of the present invention will be attained by a continuous flow type centrifuge including a main housing, an improved rotor, and a drive motor. The rotor is rotatably supported by the main housing and has a rotation axis. The rotor includes a cylindrical rotor body, a hollow cylindrical core body, end plates and welding parts. The hollow cylindrical core body, is disposed in the rotor body providing a space therebetween. The core body has a first open end, a second open end and an outer peripheral surface provided with a plurality of partitioning walls positioned at an equal interval in a circumferential direction of the core body for providing a plurality of cavities each defined by the core body, the rotor body and neighboring partitioning walls. The end plates include a first end plate disposed to cover the first open end, and a second end plate disposed to cover the second open end. The welding parts include a first welding part disposed at a boundary between the first end plate and the first open end, and a second welding part disposed at a boundary between the second end plate and the second open end. The drive motor is coupled to the rotor for rotating the rotor about the rotation axis.

DETAILED DESCRIPTION OF THE PREFERRED EMBODIMENT

Figure 1:
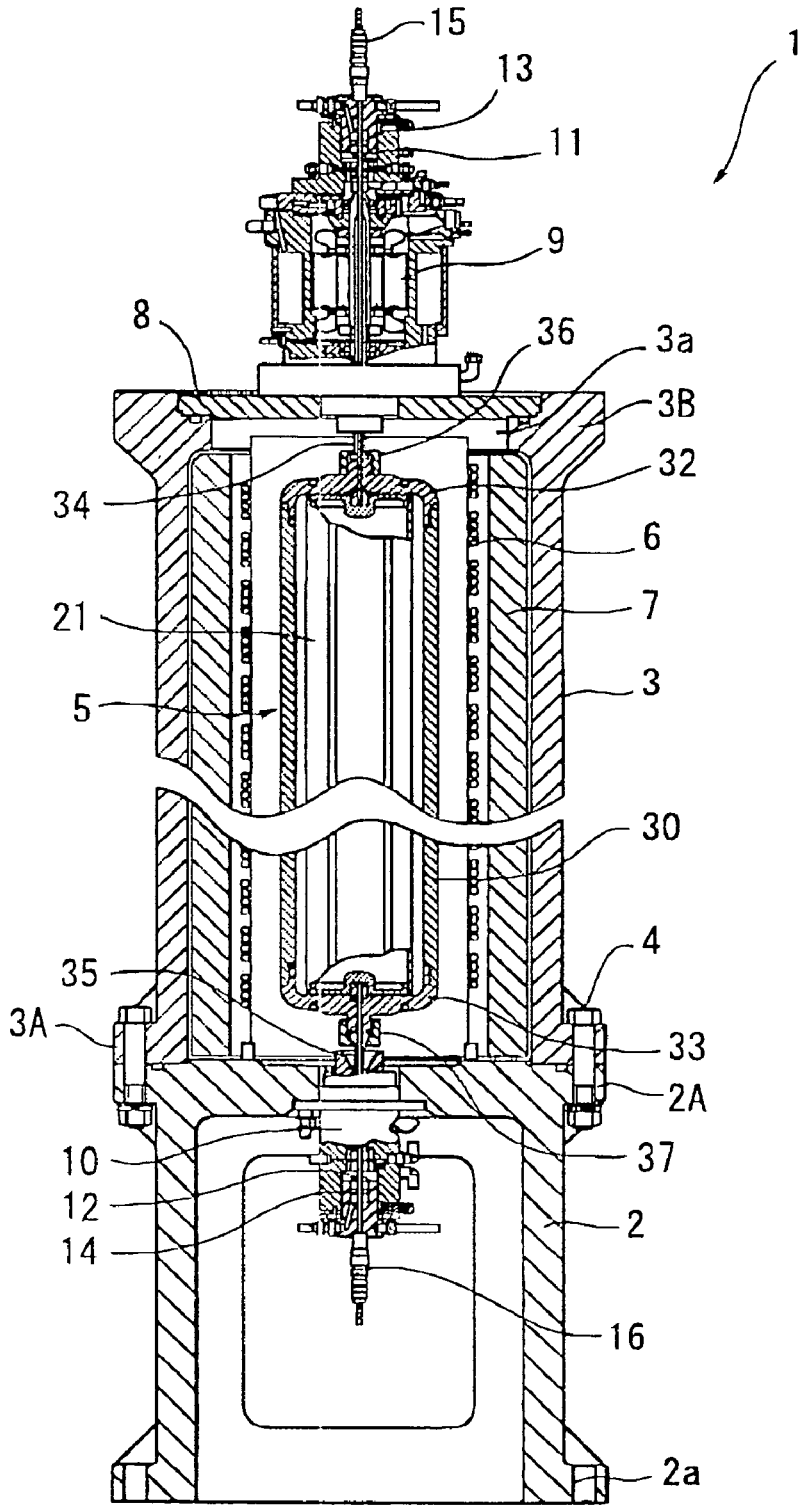
FIG. 1 is a schematic longitudinal cross-sectional view showing a continuous flow type centrifuge according to an embodiment of the present invention.

A continuous flow type centrifuge according to one embodiment of the present invention will be described with reference to FIGS. 1 through 6. A continuous flow type centrifuge 1 includes a base 2 mounted on a floor. The base 2 is formed with a fixing holes 2*a* through which anchor bolts (not shown) extend into the floor for tightly fixing the base 2 to the floor. The base 2 has an upper flange 2A formed with bolt holes.

A main housing 3 having a lower flange 3A and an upper flange 3B is mounted on the base 2. The lower flange 3A is formed with bolt holes in alignment with the bolt holes of the upper flange 2A so that bolts 4 extend through these bolt holes. Thus, the main housing 3 is rigidly secured to the base 2. A rotor chamber 3*a* is defined inside the main housing 3.

Figure 2:
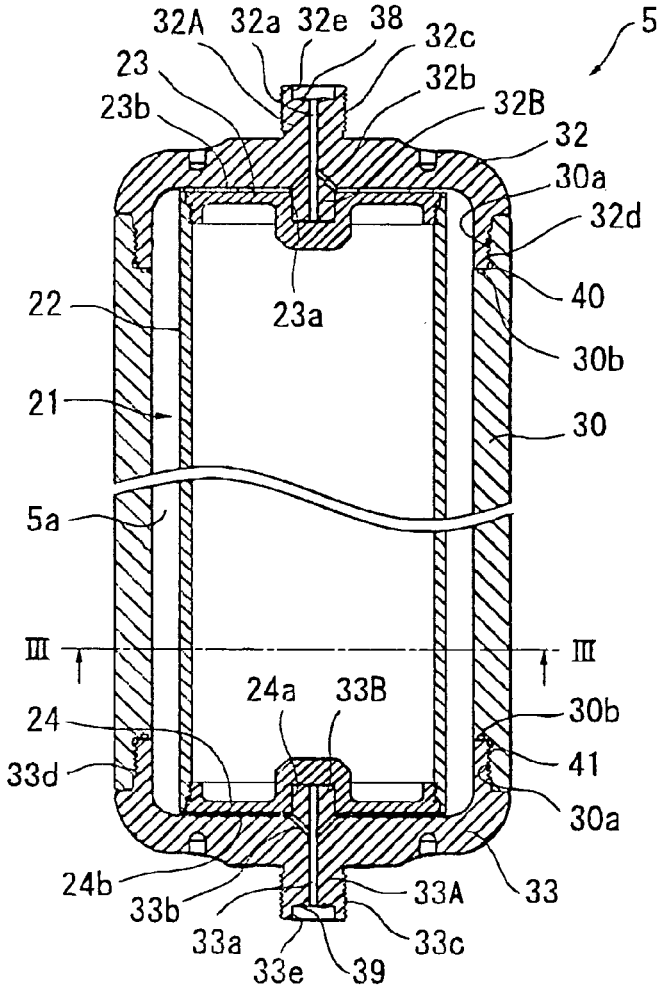
FIG. 2 is a schematic longitudinal cross-sectional view showing a rotor of the embodiment of FIG. 1.
Figure 3:
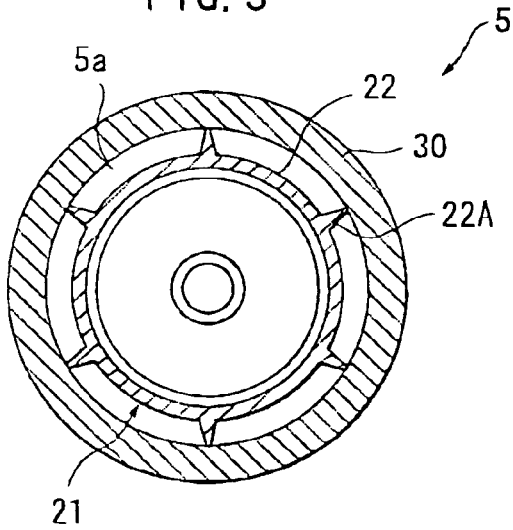
FIG. 3 is a schematic cross-sectional view taken along the line III—III in FIG. 2.

As shown in FIGS. 2 and 3, a rotor 5 is provided In the rotor chamber 3*a*, and a cooling evaporator 6 and a heater (not shown) are provided in the rotor chamber 3*a* and around the rotor 5 for keeping the rotor 5 to a predetermined temperature level. A protection wall 7 is provided around the rotor 5 for absorbing the breaking energy of the rotor 5 and for preventing broken segments of the broken rotor 5 from dashing out when the rotor 5 becomes broken. Although not shown, a vacuum pump is provided in order to reduce the pressure in the rotor chamber 3*a* so as to reduce heat generation due to windage loss of the rotor 5. A lid 8 is provided on the top of the upper flange 3B and a drive motor 9 is disposed on the lid 8 for rotating the rotor 5 about its axis.

The rotor 5 generally includes a cylindrical rotor body 30, a core 21, an upper cover 32 and a lower cover 33. The core 21 has a hollow structure and is coaxially disposed in the rotor body 30 for defining a plurality of cavities 5*a* (described later) therebetween. The upper and lower covers 32,33 cover open ends of the core. Hollow upper and lower rotation shafts 34, 35 are coaxially fixed to the upper and lower covers 32, 33, respectively, by upper and lower lock nuts 36, 37 (FIG. 1). These rotation shafts 34, 35 extend vertically and are rotatable about their axes. As shown in FIG. 2, the upper and lower covers 32, 33 are formed with fluid passages 32*a*, 32*b*, 33*a*, 33*b* which allow tubular spaces of the upper and lower rotation shafts 34, 35 to communicate with the internal space (cavities 5*a*) defined between the rotor body 30 and the core 21.

The upper rotation shaft 34 extends through the lid 8 and is coupled to the drive motor 9. More specifically, the drive motor 9 includes a hollow output shaft (not shown) into which the upper rotation shaft 34 is force-fitted, so that the output shaft and the upper rotation shaft 34 are rotatable together. As shown in FIG. 2, the upper and lower covers 32,33 are provided with upper outer boss 32A and lower outer boss 33A. The upper outer boss 32A is formed with a male thread 32*c* threadingly engagable with the lock nut 36 provided at the upper rotation shaft 34. Thus, by threadingly engaging the lock nut 36 with the male thread 32*c*, the upper rotation shaft 34 is fixedly coupled to the upper cover 32.

Similarly, the lower rotation shaft 34 is connected to the lower cover 33 by the threading engagement of the lock nut 37 provided at the lower rotation shaft 35 with a male thread 33*c* formed at the lower outer boss 33A. A damper 10 is supported at the upper flange 2A of the base 2, and a slide bearing (not shown) is disposed in the damper 10 for rotatably supporting the lower rotation shaft 35 in alignment with the upper rotation shaft 34. By the damper 10, the lower rotation shaft 35 can be slightly movable in its radial direction for absorbing rotational vibration of the lower rotation shaft 35.

In FIG. 1, an upper connector 15 is fixed to the drive motor 9. The upper connector 15 is fluidly connected to the upper rotation shaft 34 through a mechanical seal 11. The mechanical seal 11 is disposed to seal upper end face of the upper rotation shaft 34. The mechanical seal 11 is urged toward the upper end face of the upper rotation shaft 34 by a spring 13 disposed in the upper connector 15 so as to maintain hermetic seal between the stationary mechanical seal 11 and rotating upper rotation shaft 34.

Similarly, a lower connector 16 is fixed to the damper 10. The lower connector 16 is fluidly connected to the lower rotation shaft 35 through a mechanical seal 12. The mechanical seal 12 is disposed to seal a lower end face of the lower rotation shaft 35. The mechanical seal 12 is urged toward the lower end face of the lower rotation shaft 35 by a spring 14 disposed in the lower connector 16 so as to maintain hermetic seal between the stationary mechanical seal 12 and rotating lower rotation shaft 35.

To this effect, the mechanical seals 11,12 are made from a material having a low sliding frictional resistance and excellent wear resistance. Thus, the liquid sample can flow without any leakage even when the rotor 5 is rotated at high speed. The upper connector 15 and the lower connector 16 are connected to pipes (not shown) respectively. For example, the lower connector 16 function as an inlet side, and the upper connector 15 functions as a discharge side.

An input unit (not shown) is provided so as to input various parameters for the operation of the continuous centrifuge 1, for example, rotary speed of the rotor 5, selected temperature of the rotor chamber 3*a*, and duration of operation, etc. Further, a control unit (not shown) is provided for controlling various parts of the centrifuge 1 based on the input parameters.

Figure 4:
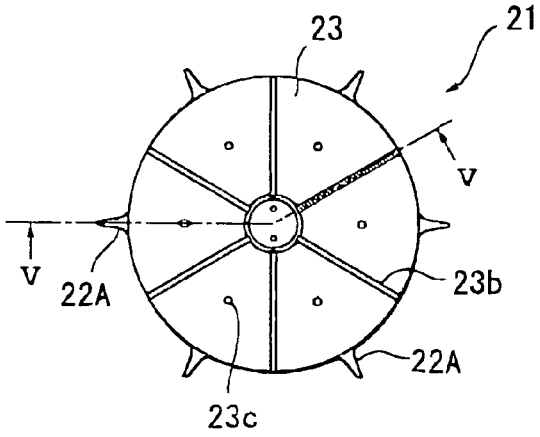
FIG. 4 is a schematic plan view showing a core of the rotor according to the embodiment of FIG. 1.

Referring to the rotor 5, as shown in FIGS. 2 through 4, the rotor 5 includes the rotor body 30, the core 21, the upper and lower covers 32, 33, and O-rings 38, 39. These components are detachably assembled. The rotor body 30, the core 21 and the covers 32, 33 are typically made from stainless steel, titanium or titanium alloy. Titanium alloy is most preferable because the specific gravity of titanium alloys is about 4.5, which is lower than the specific gravity of stainless steel and those of other types of steel whose specific gravity is about 8. Therefore, centrifugal force applied to those components is relatively small when these components is made from titanium alloy. Consequently, generated stress due to centrifugal force can be relatively low to render the rotor body 30, the covers 32, 33 and the core 21 advantageous in terms of mechanical strength. Additionally, titanium alloys have a relatively high thermal resistance and do not give rise to any structural changes and degradation of strength at least to about 500° C. Furthermore, titanium alloys are excellently anticorrosive and can withstand various detergents including aqueous solution of caustic soda. In other words, a titanium alloy is not dissolved into a detergent to adversely affect the specimen.

Female threads 30*a* and O-ring grooves 30*b* are formed at opposite inner peripheral end portions of the cylindrical rotor body 30. The covers 32 and 33 have annular end section formed with male screws 32*d*, 33*d* threadingly engagable with the female threads 30*a*, 30*a*, respectively, so that the covers 32,33 are fixed to the rotor body 30. O-rings 40, 41 are assembled in the O-ring grooves 30*b*, 30*b* so as to provide hermetic seal between the rotor body 30 and the covers 32, 33.

Inner bosses 32B and 33B protrude from the covers 32, 33 coaxially with the outer bosses 32A, 33A. The above described fluid passage 32*a* extends through center portions of the outer and inner bosses 32A, 32B, and the fluid passage 33*a* extends through center portions of the outer and inner bosses 33A, 33B. Further, distal ends of the outer bosses 32A, 33A are formed with shaft end insertion recesses 32*e*, 33*e* into which an end portions of the upper and lower rotation shafts 34,35 are inserted, respectively. Further, O-ring grooves are formed in the recesses 32*e*, 33*e* for assembling therein the above-described O-rings 38, 39 in order to provide hermetic seal between the covers 32,33 and the rotation shafts 34, 35.

The core 21 includes a hollow cylindrical core body 22 and end plates 23,24 disposed to cover open ends of the hollow core body 22. A plurality of partition walls 22A radially outwardly protrude from an outer peripheral surface of the core body 22 to the inner peripheral surface of the rotor body 30 at an equal interval in a circumferential direction of the core body 22, and extend in the axial direction of the core body 22. As a result, a plurality of the cavities 5*a* each having a generally sector shape are defined among the neighboring partition walls 22A, 22A, the outer peripheral surface of the core body 22 and the inner peripheral surface of the rotor body 30, when the core body 22 is set in a predetermined position of the rotor body 30.

Figure 5:
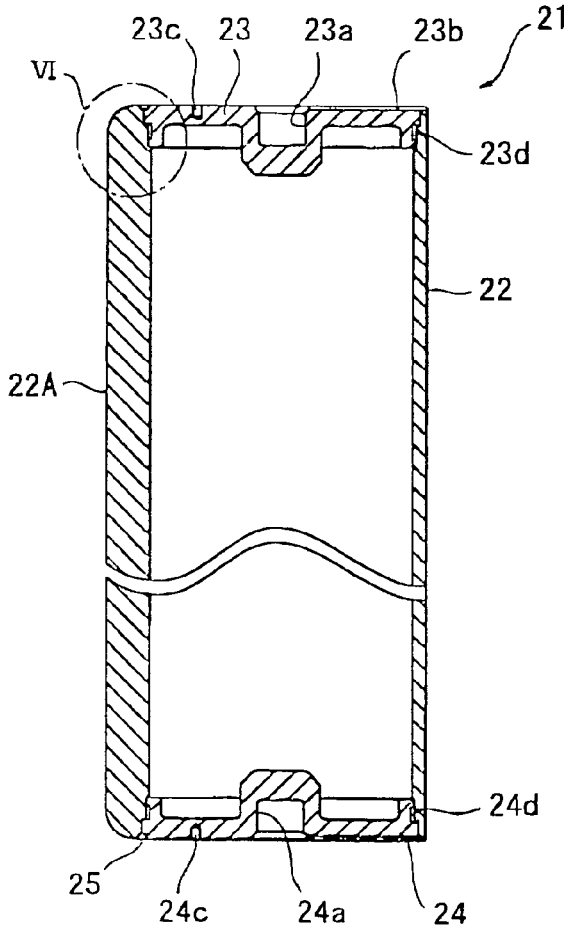
FIG. 5 is a schematic cross-sectional view of the core taken along the line V—V in FIG. 4.

The end plates 23, 24 have center portions formed with recessed portions 23*a*, 24*a* in fitting engagement with the Inner bosses 32B, 33B, respectively. A plurality of grooves 23*b*, 24*b* are formed radially on the surfaces of the end plates 23, 24. The numbers of the grooves 23*b* and 24*b* corresponds to the number of the cavities 5*a*. These grooves 23*b*, 24*b* are in fluid communication with the fluid passages 32*b*, 33*b* branched from the fluid passages 32*a*, 33*a*. Therefore, liquid sample can be introduced into or discharged from the cavities 5*a* through these grooves 23*b*, 24*b*. Further, as shown in FIGS. 4 and 5, a plurality of pin holes 23*c*, 24*c* are formed in the end plates 23, 24 so as to allow pins (not shown) to be inserted through these pin holes 23*c*, 24*c* in order to prevent the core body 22 and the rotor body 30 from relative rotational displacement. The components of the core 21 are made from titanium or titanium alloy.

Figure 6:
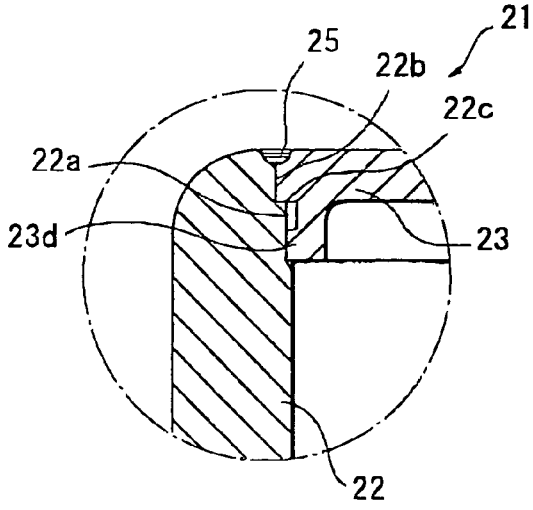
FIG. 6 is an enlarged longitudinal cross-sectional view of the part VI in FIG. 5.
Figure 7:
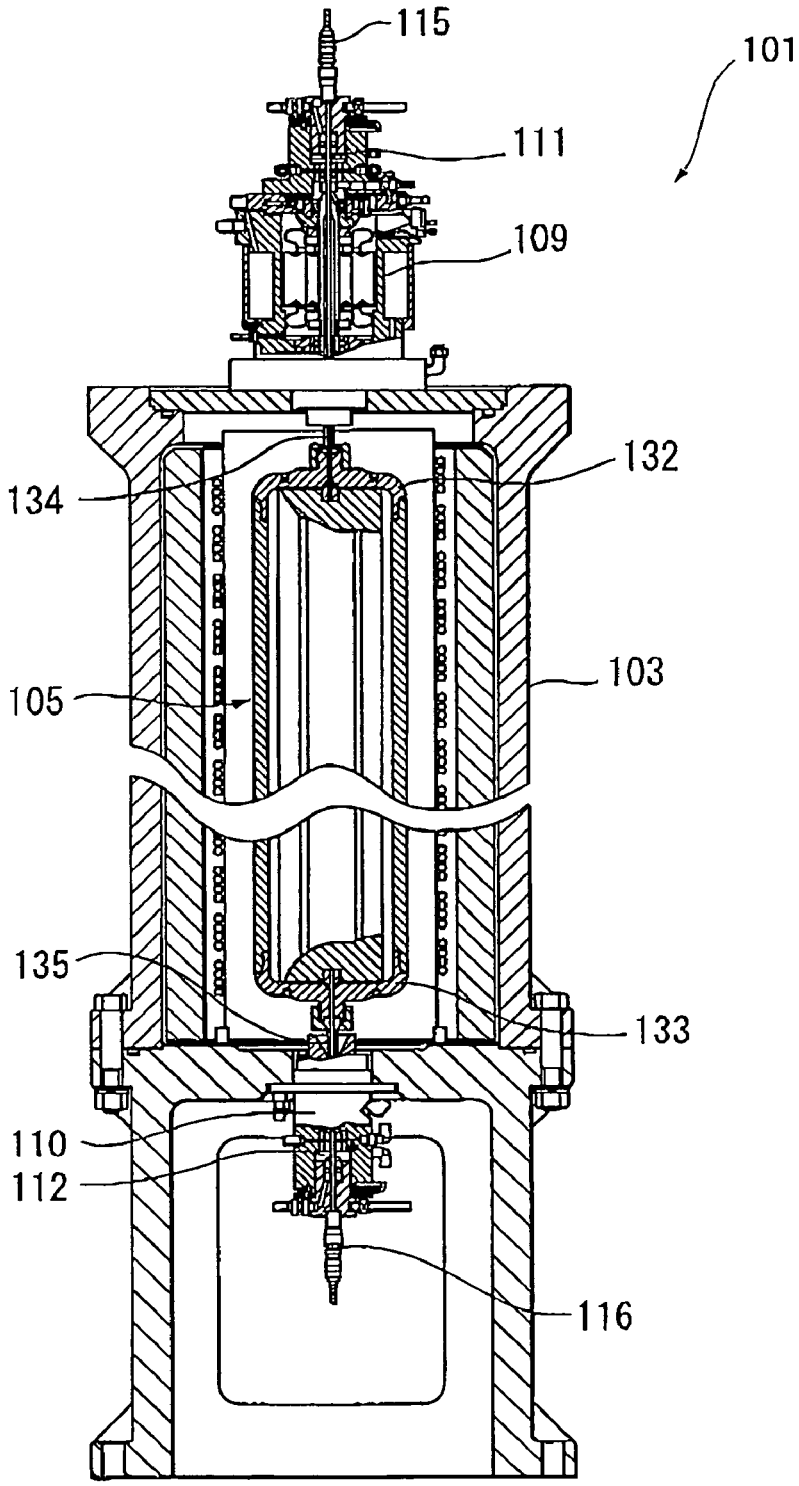
FIG. 7 PRIOR ART
FIG. 7 is a schematic cross-sectional view showing a conventional continuous flow type centrifuge.
Figure 8:
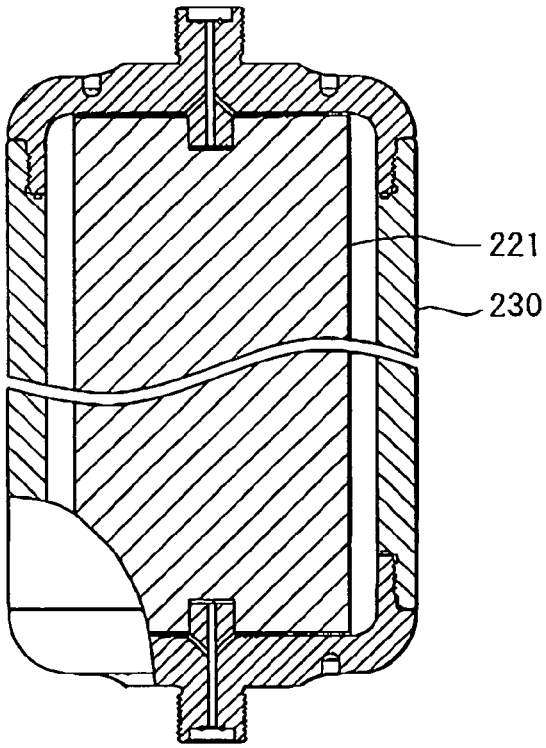
FIG. 8 RELATED ART
FIG. 8 is a schematic cross-sectional view showing a rotor in a continuous flow type centrifuge of a related art.
Figure 9:
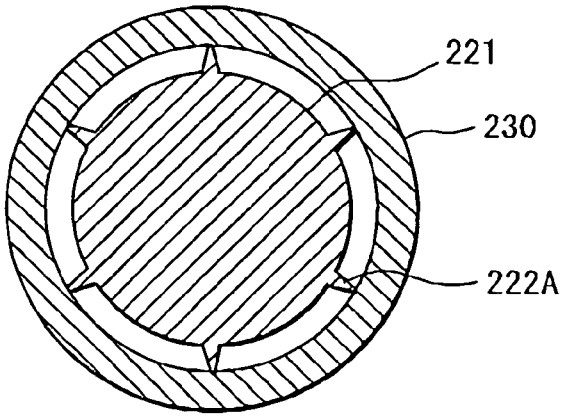
FIG. 9 RELATED ART
FIG. 9 is a schematic cross-sectional view taken along line VIII—VIII in FIG. 8.

FIGS. 5 and 6 show assembly of the end plate 23 to the core body 22. Female screw sections 22*a* are formed at the opposite end portions of the core body 22, and male screw sections 23*d*, 24*d* threadingly engageable with the female screw sections 22*a* are formed in the end plates 23, 24. Further, fitting holes 22*b* are formed at the opposite ends of the core body 22. Inner diameter of the fitting hole 22*b* is substantially equal to an outer diameter of the end plates 23, 24, and slightly greater than the inner diameter of the female screw sections 22*a* to provide stepped portions 22*c*. The stepped portions 22*c* function as stops so as to regulate threadingly advancing position of the end plates 23,24 relative to the core body 22. In other words, fixing positions of the end plates 23, 24 relative to the core body 22 can be fixed when the end plates 23, 24 are brought into abutment with the stepped portions 22*c* as a result of threading advancing movement of the end plates 23 24.

Further, the fitting holes 22*b* facilitate insertion of the male thread sections 23*d*, 24*d* into the female thread sections 22*a*. More specifically, Coincidence between center axes of the end plates 23, 24 and a center axis of the core body 22 is not precisely established due to minute clearance between the female screw sections 22*a* and the male screw sections 23*d*, 24*d*. To avoid this problem, the outer peripheral surfaces of the end plates 23*d*, 24*d* are designed to be fitted with the inner peripheral surface of the fitting holes 22*b* to provide the concentric arrangement among the end plates 23, 24 and the core body 22.

Boundaries between a contour of the fitting hole 22*b* and the circular contour of the end plates 23, 24 are subjected to welding to provide annular welded parts 25 along the entire minute gaps defined therebetween. Then, any projections that have been produced by the welding at the welded parts 25 are machined, and further, the above-described grooves 23*b*, 24*b* are machined to dimensionally fit to the inner surfaces of the rotor body 30. Since the core 21 has a hollow structure, the resultant rotor 5 can reduce its weight. Additionally, since the end plates 23, 24 are screwed into the core body 22 and further welded to the core body 22, the resultant core 21 can provide enhanced mechanical strength.

Incidentally, the core 21 is replaceable. As a matter of fact, several different types of cores 21 are provided and a suitable one of the cores 21 is selectively used in accordance with kind and volume of liquid sample to be centrifuged. A lift arm (not shown) can be connected to the lid 8 for replacing the core 21. To replace the core 21, the lid 8, the drive motor 9 and the rotor 5 are firstly taken out together by moving the lift arm vertically. Then, the lock nut 36 is unfastened so that the upper rotation shaft 34 is taken out from the upper cover 32. Thereafter, the upper cover 32 is removed from the rotor body 30. Thus, the core 21 can be replaced by a new core 21.

For performing centrifugal separation, the liquid sample is introduced into the respective cavities 5*a* from the connector 16 through the mechanical seal 12, the fluid passages 33*a*, 33*b* and the radial grooves 24*b*. Then while the liquid sample flows vertically in the sector-shaped cavities 5*a*, the liquid sample is subjected to centrifugal force by the rotation of the rotor 5 so that micro-particles contained in the specimen remains within the cavities 5*a* while only the supernatant liquid is discharged outside through the radial grooves 23*b*, fluid passage 32*b*, 32*a*, rotation shaft 34, mechanical seal 11 and connector 15.

In order to investigate superiority of the above-described embodiment, the present inventors prepared a centrifuge 1 with the core 21 made from titanium and performed centrifugal separation, and concluded that the centrifuge 1 did not incur any trouble when the rotor 5 was driven to rotate up to 40,000 rpm, and hence the core 21 could satisfactorily withstand the stress caused by the load of the centrifugal force that was generated during rotation of the core 21.

When sterilization by steam (in an autoclave) is to be performed with respect to the centrifuge 1 that were held In contact with a liquid sample, it is desirable that steam is introduced from the upper connector 15, and a valve is provided to the lower connector 16 so as to regulate internal pressure of the rotor 5.

Further, at least one temperature sensor can be disposed in the connectors 15, 16 and in the rotor chamber 3*a* to detect the temperature of the rotor 5 the temperature of the steam while the centrifuge 1 is being sterilized by steam. Further it is found that the centrifuge 1 could be satisfactorily sterilized by repeated sterilization by steam at 121° C. for 20 minutes. When the centrifuge was washed with a 1% aqueous solution of caustic soda, it was found the result of the sterilizing operation was satisfactory. Not more than 10% concentration of caustic soda in an aqueous solution can be used for washing a centrifuge according to the embodiment because titanium can withstand an aqueous solution of caustic soda containing caustic soda up to 10%.

Furthermore, the hollow core 21 had a mass of 7.5 kg and hence was lighter than an ordinary known solid core made from a plastic material and having a mass of 7.9 kg. Thus, a centrifuge according to the present embodiment is commercially feasible and can be handled satisfactorily for transportation, assemblage and operation.

As described above, since the rotor body 30, the covers 32,33 and the core 21 are made of materials that can withstand a temperature level exceeding 130° C. and do not incur any trouble due to thermal deformation, the centrifuge 1 according to the embodiment can be sterilized by means of steam at 121° C. for 20 minutes while the rotor 5 is rotatably assembled, and the centrifuge 1 can promptly be operated in order to centrifuge the specimen in a sterilized state without any additional process immediately after the sterilization. Additionally, since the rotor body 30, the covers 32, 33 and the core 21 are made from a highly anticorrosive material, the specimen flow passages of the centrifuge 1 can be washed by flowing a low concentration aqueous solution of caustic soda through the flow passages. Therefore, in certain occasions, the centrifuge can be operated repeatedly without dismounting and mounting the rotor 5 to consequently improve productivity of the centrifuging process. Additionally, since the metal-made core 21 is designed hollow so as to reduce its weight and since both screw fastening and welding connection are employed for assembly, the core is lightweight and has high mechanical strength. Thus, the resultant centrifuge 1 can withstand high-speed operations to enhance centrifuging performance.

While the invention has been described in detail and with reference to specific embodiment thereof, it would be apparent to those skilled in the art that various changes and modifications may be made therein without departing from the spirit and scope of the invention. For example, in the above-described embodiment the liquid sample is forced to flow from the lower part (connector 16) to the upper part (connector 15) of the centrifuge 1. Instead, the liquid sample can be flowed from the upper part to the lower part. Further, the hollow rotation shafts 34, 35 are preferably formed of heat resistant and anti-corrosive material such as titanium and titanium alloy.

What is claimed is:

1. A continuous flow type centrifuge comprising:

a main housing;

a rotor rotatably supported by the main housing and having a rotation axis, the rotor comprising a cylindrical rotor body;

a hollow cylindrical core body disposed in the rotor body providing a space therebetween, the core body having a first open end, a second open end and an outer peripheral surface provided with a plurality of partitioning walls positioned at an equal interval in a circumferential direction of the core body for providing a plurality of cavities each defined by the core body, the rotor body and neighboring partitioning walls;

end plates comprising a first end plate disposed to cover the first open end, and a second end plate disposed to cover the second open end; and welding parts comprising a first welding part disposed at a boundary between the first end plate and the first open end to cover gaps between the first end plate and the first open end, and a second welding part disposed at a boundary between the second end plate and the second open end to cover gaps between the second end plate and the second open end; and a drive motor coupled to the rotor for rotating the rotor about the rotation axis.

2. The continuous flow type centrifuge as claimed in claim 1, further comprising:

a fluid inlet unit in fluid communication with the plurality of cavities; and a fluid outlet unit in fluid communication with the plurality of cavities.

3. The continuous flow type centrifuge as claimed in claim 1, wherein the rotor body, the core body and the end plates are made from a material providing a heat resistance up to a temperature of 130° C. without degradation of mechanical strength.

4. The continuous flow type centrifuge as claimed in claim 1, wherein the rotor body, the core body and the end plates are made from a material providing a corrosion resistance against caustic soda of not more than 10% concentration.

5. The continuous flow type centrifuge as claims in claim 1, wherein the core body and the end plates are made from one of titanium and titanium alloy.

6. The continuous flow type centrifuge as claimed in claim 1, wherein the first end plate is threadingly engaged with the first open end and the second end plate is threadingly engaged with the second open end.

7. The continuous flow type centrifuge as claimed in claim 6, wherein the first end plate and the second end plate have a first outer diameter and are formed with male thread sections having a second outer diameter smaller than the first outer diameter, wherein the first open end and the second open end have open end sections having a first inner diameter substantially equal to the first outer diameter, and have female thread sections threadingly engagable with the male thread section and having a second inner diameter smaller than the first inner diameter to provide stepped portions at boundary between the open end sections and the female thread sections, the end plates being ultimately abuttable on the stepped portions, and wherein the first and second welding parts are respectively disposed to cover gaps between the first outer diameters of the first and second end plates and the first inner diameters of the first and second open ends.

* * * * *